United States Patent [19]

Carson et al.

[11] 4,034,684

[45] July 12, 1977

[54] WORKBENCH AND FOLDABLE LEG ASSEMBLY THEREFOR

[75] Inventors: Norman Harold Carson; Raul Cirne, both of Brockville; Horst Zahn, Ontario, all of Canada

[73] Assignee: The Black and Decker Manufacturing Company, Towson, Md.

[21] Appl. No.: 612,073

[22] Filed: Sept. 10, 1975

[30] Foreign Application Priority Data

Sept. 12, 1974 Canada ..... 209110

[51] Int. Cl.[2] ..... A47B 3/00

[52] U.S. Cl. ..... 108/127; 248/188.6; 108/144

[58] Field of Search ..... 108/127, 156, 160, 121, 108/122, 123, 133, 131, 144; 269/244; 126/304 R; 248/188.6, 188.4

[56] References Cited

U.S. PATENT DOCUMENTS

| | | | |
|---|---|---|---|
| 226,198 | 4/1880 | Roberts | 126/304 R |
| 1,044,879 | 11/1912 | Fye | 248/188.6 |
| 1,459,539 | 6/1923 | Kruesheld | 126/304 R |
| 2,706,138 | 4/1955 | Luce et al. | 108/127 X |
| 3,610,224 | 10/1971 | Marshall | 248/188.6 |
| 3,841,619 | 10/1974 | Hickman | 269/244 |
| 3,851,756 | 12/1974 | Brown | 108/131 X |
| 3,868,079 | 2/1975 | Johnson | 248/188.4 |

FOREIGN PATENT DOCUMENTS

| | | | |
|---|---|---|---|
| 1,099,001 | 3/1955 | France | 108/127 |

*Primary Examiner*—James T. McCall
*Attorney, Agent, or Firm*—Edward D. Murphy; Walter Ottesen; Leonard Bloom

[57] ABSTRACT

An improved foldable leg assembly for dual-height workbenches and like devices which is simple to construct, requires no foldable braces or stays, employs an extremely simple hinge plate structure to connect same to a workbench base, the legs being oriented and arranged to provide adequate stability in the higher position of the workbench. The dual height workbench includes top members defining a working surface, a base defining longitudinal and transverse axes and support structure for supporting said top members above said base. A plurality of leg members are pivotally attached to said base adjacent outer edge portions of same and movable between inwardly folded inoperative positions corresponding to the lower height of the workbench and outwardly and downwardly inclined operative positions relative to said base corresponding to the higher position of the workbench. The pivotal attachment of the respective legs is such that each of said legs is capable of movement in an arc lying in a plane which is at an acute angle relative to the longitudinal and transverse axes of said base. Each said leg includes at its upper end pivot axis defining means, with a portion of said upper end spaced from said pivot axis defining means being shaped to transmit thrust forces to said base and to limit the degree of outward pivotal motion of said leg thus to define the outwardly and downwardly inclined operative position of each leg.

20 Claims, 13 Drawing Figures

FIG. 1
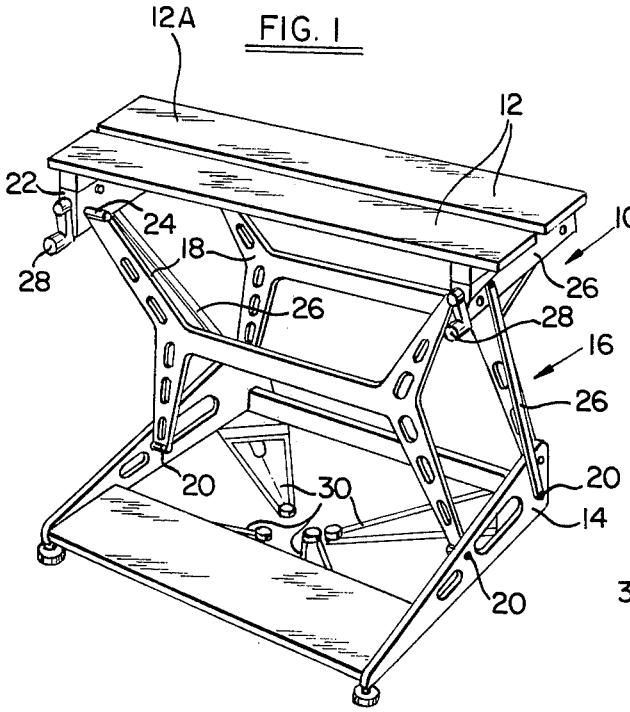
FIG. 3
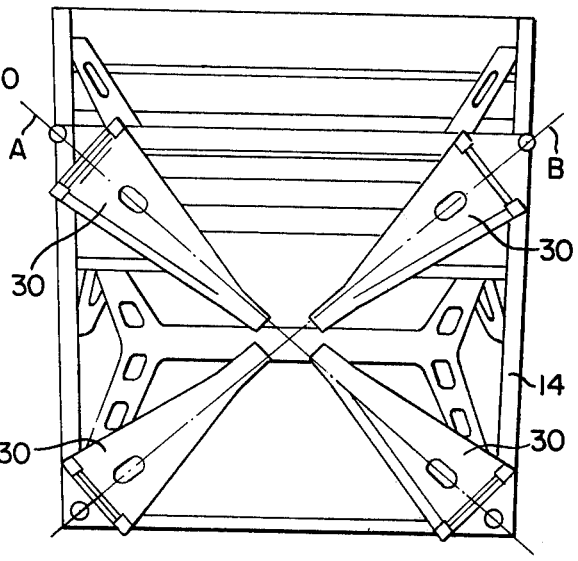
FIG. 2
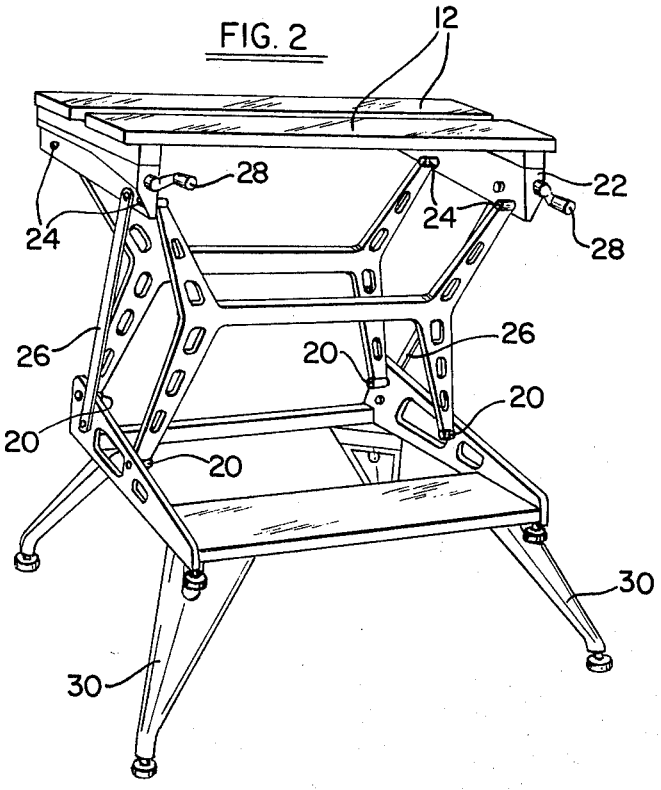
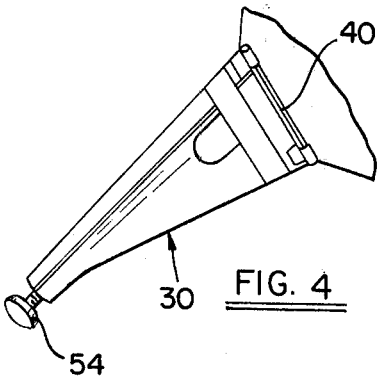
FIG. 4

FIG. 11
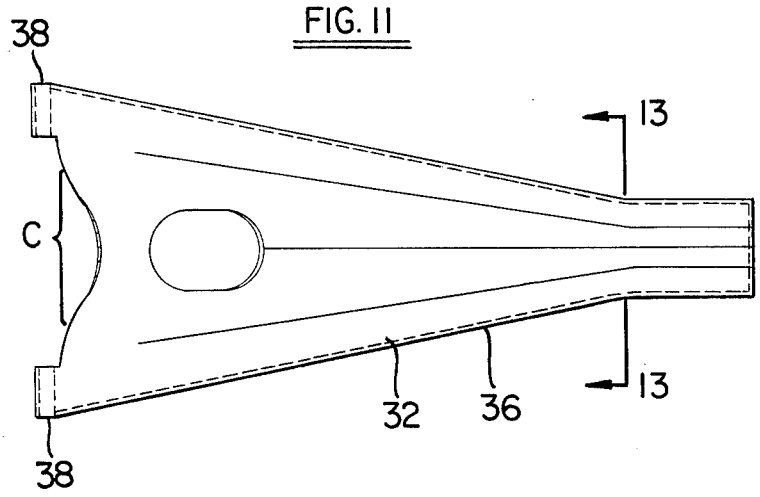
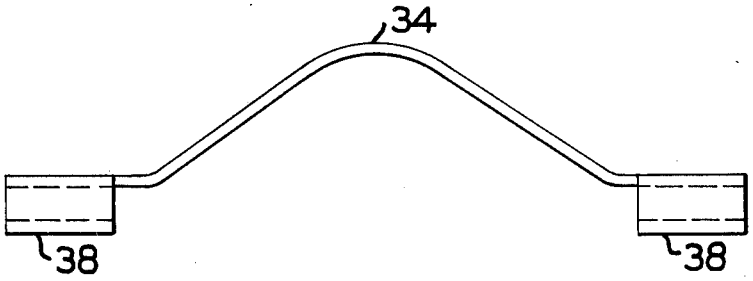
FIG. 12
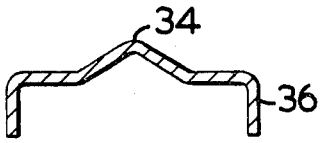
FIG. 13

WORKBENCH AND FOLDABLE LEG ASSEMBLY THEREFOR

BACKGROUND OF THE INVENTION

This invention relates to a foldable leg assembly specially adapted for use with workbenches and other heavy duty applications where strength, stability, ease of access and simplicity of construction are of primary importance. The invention is particularly adapted for use in workbenches the invention is particularly adapted for use in workbenches and the like wherein a dual height working surface is desired and, accordingly utilizes pivotally mounted legs movable from a folded inoperative position corresponding to the lower of the two positions to an unfolded operating position corresponding to the higher of the two positions.

One form of workbench for which the present invention is particularly suited is described in U.S. Pat. No. 3,615,087 issued Oct. 26, 1971 to R. P. Hickman. This patent describes a workbench including a support bearing a pair of top members lying in a plane and defining a working surface with at least one of the top members being movable towards and away from the other upon actuation of a pair of spaced independently operable clamping devices to vary the gap between the top members and permit the clamping of a wide variety of work pieces relative to the work surface. The support structure includes a rectangular base and a frame assembly extending between the base and the top members. The frame assembly includes a pair of frame members pivotally connected in such fashion as to permit movement between an erected working position wherein the top members are spaced above the base and a collapsed position in which the top members are in close juxaposition to the base.

In order to provide a dual height working surface for the above noted structure, there has hitherto been provided a foldable leg structure for securement to the base member. Such leg structure included a leg pivotally connected at each of the four corners of the rectangular base in such manner that, when folded, the legs move into general alignment with the opposed ends of the base. In order to support the legs in the unfolded or erected position, foldable braces or struts were employed. However, such foldable braces, in addition to making the structure somewhat more complicated, made the structure more difficult to manipulate; furthermore, the braces, in their erected positions, were apt to interfere with the user's feet and thus affect the user's forward access to the workbench.

There is also the problem of stability to be considered. In the higher of the two positions of the workbench there is the requirement that the support legs be oriented such that increased resistance to tipping of the workbench is provided. Good stability is an extremely important requirement when it is considered that, in workbenches of the type discussed above, the user often sits upon a portion of the working surface of the workbench, depending on the nature of the work being done, and thus is apt to be injured if the workbench topples over.

With further reference to typical prior art structures, it is noted that various types of folding leg structures have been provided on lightweight card tables and portable picnic tables. However, in general, it may be said that these structures are not suitable for heavy duty use in workbenches or the like since the overall design of the pivot bracket in most of these structures is unduly complex and thus overly costly to produce particularly in applications where high strength is required. In addition, the design of the legs, per se, is usually inadequate for applications where relatively large forces and bending moments may be involved.

SUMMARY OF THE INVENTION

Accordingly the various aspects of the present invention seek to alleviate the above described disadvantages and to provide an improved foldable leg assembly for dual-height workbenches and like devices which is simple to construct, requires no foldable braces or stays, employs an extremely simple hinge plate structure to connect same to a workbench base, the legs being oriented and arranged to provide adequate stability in the higher position of the workbench. Thus, in accordance with one aspect of the invention there is provided a dual height workbench or the like comprising: top members defining a working surface, a base defining longitudinal and transverse axes; support structure for supporting said top members above said base, a plurality of leg members pivotally attached to said base adjacent outer edge portions of same and movable between inwardly folded inoperative positions corresponding to the lower height of the workbench and outwardly and downwardly inclined operative positions relative to said base corresponding to the higher position of the workbench, the pivotal attachment of the respective legs being such that each of said legs is capable of movement in an arc lying in a plane which is at an acute angle relative to the longitudinal and transverse axes of said base, each said leg including at its upper end pivot axis defining means, with a portion of said upper end spaced from said pivot axis defining means being shaped to transmit thrust forces to said base and to limit the degree of outward pivotal motion of said leg thus to define the outwardly and downwardly inclined operative positions of each leg.

In a further aspect, the pivot axis defining means in each leg includes aperture defining means receiving a pivot pin oriented to provide said movement of its associated leg in said arc.

In a further aspect of the invention each of said legs is connected to said base via a hinge plate secured to said base, said hinge plate comprising a plate having loops formed therein receiving the pivot pin, said loops disposed immediately adjacent the aperture defining means of said leg.

In a still further aspect of the invention said leg includes a one-piece elongated sheet metal piece having a longitudinally extending crimp therein such that, as seen in cross-section, edge portions of such leg are offset from inwardly disposed portions of the leg sufficiently to assist in providing the required degree of leg strength.

In a further aspect, said portion of said upper end of said leg is shaped such that it defines a line of contact lying in a single plane whereby said thrust forces are distributed along said line.

In a still further aspect, said portion of said upper end of said leg is arranged to contact the hinge plate along said line of contact to provide upper proper distribution of forces.

In a still further aspect, the aperture defining means of each said leg is capable of contacting and transmitting thrust forces to said base.

In one form of the invention the base is of generally rectangular configuration with said leg members each being connected thereto adjacent a respective one of the four corners of the base.

A still further feature of the invention provides means for resiliently holding each said leg in the folded inoperative position and the outwardly disposed operative position.

In a typical embodiment of the invention, said base is provided with a plurality of support feet for contacting a floor surface in the lower position of the workbench, each support foot being located adjacent a respective one of said legs, and each said leg having a recess or opening therein for receiving a portion of the associated support foot therein in the operative position of such leg whereby to avoid interference between each leg and the adjacent support foot of the base.

As a still further feature of the invention, each of the legs is provided with a respective floor contacting means with the legs being shaped such that when the legs are in their operative positions, their floor contacting means are disposed a substantial distance outwardly beyond the margins of the base, as seen in plan view, to provide added stability to the workbench in the higher position of same.

The invention, in all its many aspects, is particularly well suited for workbench structures wherein the support structure for supporting the top members above the base has pivot means associated therewith to permit the workbench to be collapsed and the top members brought into juxtaposition with the base for ease of transport and storage of the workbench.

In a separate aspect of the invention there is provided a leg and hinge plate assembly wherein said leg is movable in an arc relative to the hinge plate between a folded inoperative position, said leg including pivot axis defining means at one end and a floor contacting means as its opposite end, and the hinge plate having pivot axis defining means co-operating with the pivot axis defining means of said leg, said leg being shaped in a region spaced from its pivot axis defining means at said one end to transmit thrust forces to the hinge plate and define the unfolded or extended operative position of the leg, the leg including a one-piece elongated sheet metal piece which narrows in width toward said opposite end and shaped so that, as seen in cross-section, edge portions of said leg are offset from inwardly disposed portions of the leg to provide the required degree of resistance of said leg to bending forces.

Additional important features of the invention may be had from the claims appended hereto.

BRIEF DESCRIPTION OF THE DRAWING

The invention will be further understood from the following description of the preferred embodiment of same with reference being had to the accompanying drawings, in which:

FIG. 1 is a perspective view of a workbench incorporating the principles of the invention with the pivotally mounted legs being shown folded to inwardly located inoperative positions.

FIG. 2 is a perspective view of the workbench with the legs shown in their outwardly and downwardly inclined operative positions relative to the workbench base.

FIG. 3 is a bottom view of the workbench in a collapsed position with the legs folded inwardly.

FIG. 4 is a perspective view of one of the legs shown from the underside in the open position.

FIG. 11 is a top plan view of one of the legs.

FIG. 12 is an end elevation view of the leg structure shown in FIG. 11 illustrating the crimped cross-sectional configuration of same.

FIG. 13 is a section view taken along line 13—13 of FIG. 11.

DESCRIPTION OF THE PREFERRED EMBODIMENTS OF THE INVENTION

Figure 5:
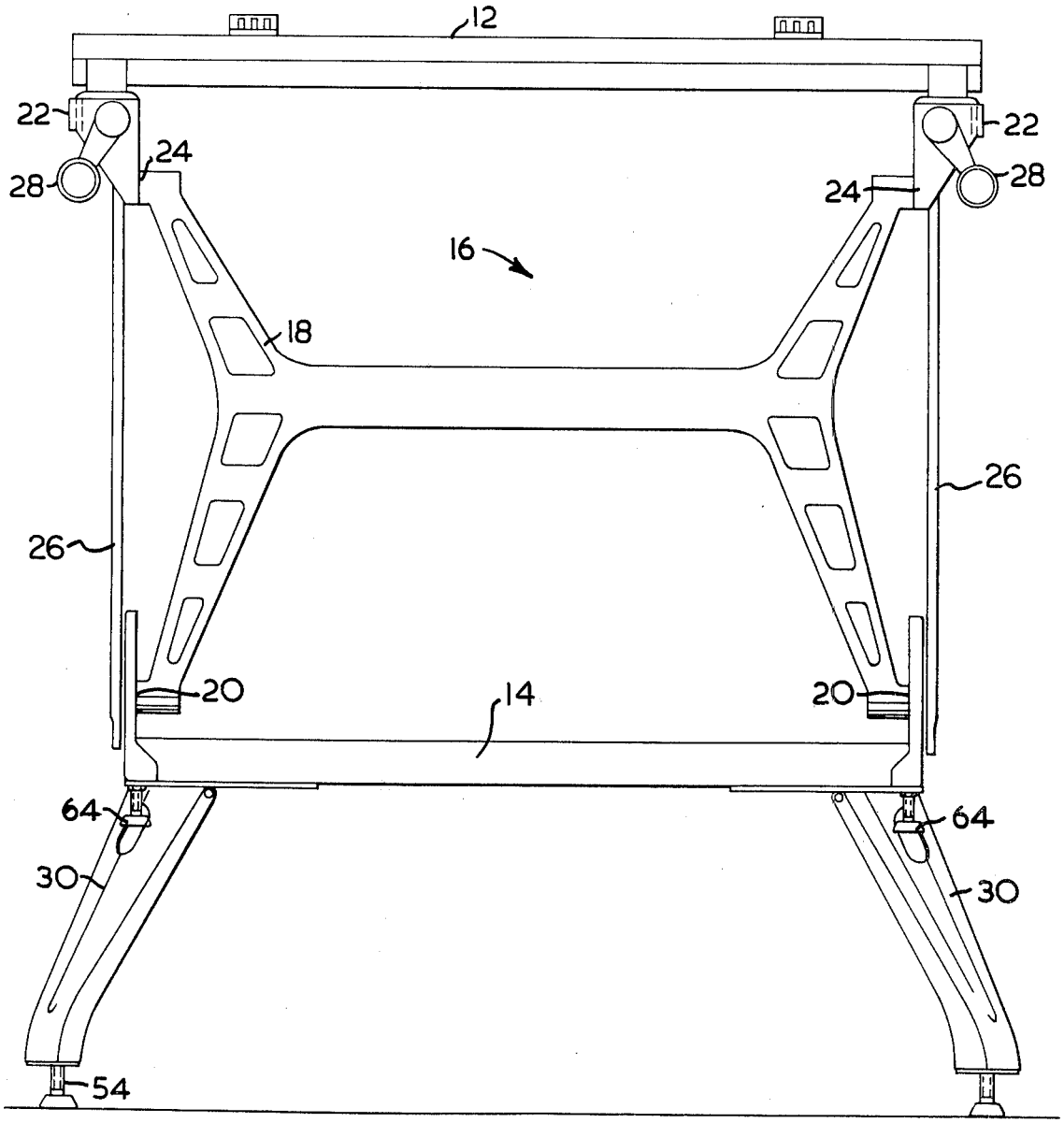
FIGS. 5 and 6 are side and end elevation views respectively of the workbench in its operative position, the legs being in their outwardly and downwardly inclined operative locations relative to the base.

With reference now to the drawings, particularly FIGS. 1, 2, 5 and 6, there is shown a dual height workbench 10 including a pair of relatively movable top members 12 defining a working surface. The workbench also includes a skeleton or outline type base of generally rectangular configuration and identified by the reference numeral 14. The workbench also includes a support structure broadly indicated by the reference numeral 16 for supporting top members 12 above the base 14.

As described more fully in U.S. Pat. No. 3,615,087 issued Oct. 26, 1971 to Hickman, the support structure 16 includes a pair of spaced apart generally H shaped frames 18 pivotally connected to the base member 14 at points 20 and pivotally connected to the top member support structure 22 at points 24. By virtue of this arrangement, the workbench may go from the working positions as shown in FIGS. 1, 2, 5 and 6 to a collapsed storage position in which the top members 12 are in close juxtaposition to the base 14. Side mounted locked bars 26 serve to retain the workbench in the working position.

In addition, the top support structure 22, upon which the top members 12 are mounted, includes means permitting one of the top members, e.g. top member 12*a*, to be moved towards and away from the other top member to permit workpieces and other objects to be clamped between the top members 12. This feature forms no part of the present invention and is fully described in the above noted U.S. Pat. No. 3,615,087. It is sufficient to note here that the top support structure has mounted therein screw thread elements (not shown) which are actuated by rotation of crank handles 28 located adjacent opposing ends of the workbench whereby to permit the gap between the top members 12 to be varied at will. As described in the above noted U.S. patent, the gap between the top members 12 may be greater at one end than at the other whereby to allow for the clamping of odd-shaped work pieces.

In accordance with the invention, the workbench includes a plurality of legs 30 which are each pivotally attached to the base adjacent a respective one of the four corners of the base. Each of the legs 30 is movable between an inwardly folded inoperative position corresponding to the lower height of the workbench as illustrated in FIG. 1 wherein the base 14 is supported on the floor directly, and outwardly and downwardly inclined operative positions relative to the base corresponding to the higher position of the workbench as illustrated for example in FIG. 2. It will be seen hereinafter that th pivotal attachment of the respective legs 30 to base 14 is such that each of said legs is capable of movement in an arc lying in a plane which is at an acute angle relative to the longitudinal and transverse axes of the rectangular base 14. As shown in the preferred embodiment, the above mentioned planes in which the respective legs 30 pivot are parallel to lines arranged diagonally relative to the rectangular base member. It will be readily seen from the bottom view of FIG. 3 that diagonally opposed pairs of legs 30 are arranged generally parallel to respective ones of the diagonal lines A and B. It will of course be appreciated that it is not necessary that the legs be pivoted such that they lie exactly in diagonally oriented planes as indicated above and, in fact, it will be seen from FIG. 3 that the legs do in fact deviate from such diagonally oriented lines by a few degrees. The exact orientation of the legs will depend upon the aspect ratio of the base 14 and will be chosen such as to provide optimum stability of the workbench in both the longitudinal and transverse directions.

With particular reference to FIGS. 7–13, it will be seen that each of the legs 30 includes a one-piece elongated sheet metal piece 32 (see FIGS. 11, 12 and 13) the metal piece 32 having a longitudinally extending crimp 34 therein such that, asseen in cross-section, the edge portions 36 of such leg are offset from the inwardly disposed portions of the leg sufficiently as to provide the required degree of leg strength. Of course, the thickness of the metal used will be such as to avoid buckling of the leg 30 in use.

The upper end of each leg 30 is provided with aperture defining means 38 for receiving a hinge pin 40. The aperture defining means 38, as best seen in FIG. 8 and FIG. 11 comprise extended edge portions of the above mentioned one-piece sheet metal structure which is curled around upon itself as best seen in FIG. 8 to provide an aperture 42 of the required diameter.

Figure 9:
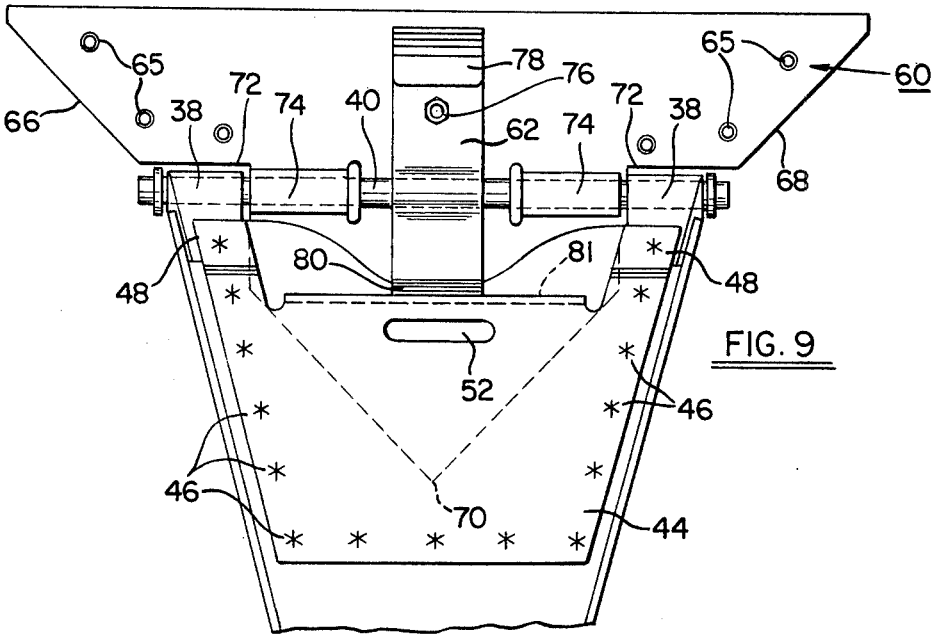
FIG. 9 is a bottom view of the upper end of the leg in combination with the hinge plate and spring clip assembly for retaining the leg in either the operative or inoperative position.

The further strengthen leg 30, the underside of the upper end of same is provided with reinforcement plate 44 as best seen in FIG. 9 which is spot welded at points 46 to sheet metal member 32 at spaced points. It will be noted that the uppermost ends of the reinforcement plate 44 include extended portions 48 which extend upwardly to points closely adjacent the aperture defining means 38, as best seen in FIG. 8, and are spot welded there in superimposed relation to the metal portions which have been curled to define the above mentiond apertures 42 thereby providing adequate strength and a rigid structure. In addition to the above features, the reinforcement plate 44 includes tab 50 and a generally elongated aperture 52 which cooperate with spring clip means for maintaining the leg either in an inoperative or an operative position as will be described more fully hereinafter.

It will also be seen that the lowermost end of each leg 30 includes inwardly turned metal portions to which is welded a metal piece 55 having an extruded and internally threaded portion 55' which is internally threaded to receive an adjustable floor or ground engaging foot 54. The foot 54 is provided with threaded stud 56 and lock nut 58 so that the workbench, in use, may be readily leveled.

Figures 7, 8:
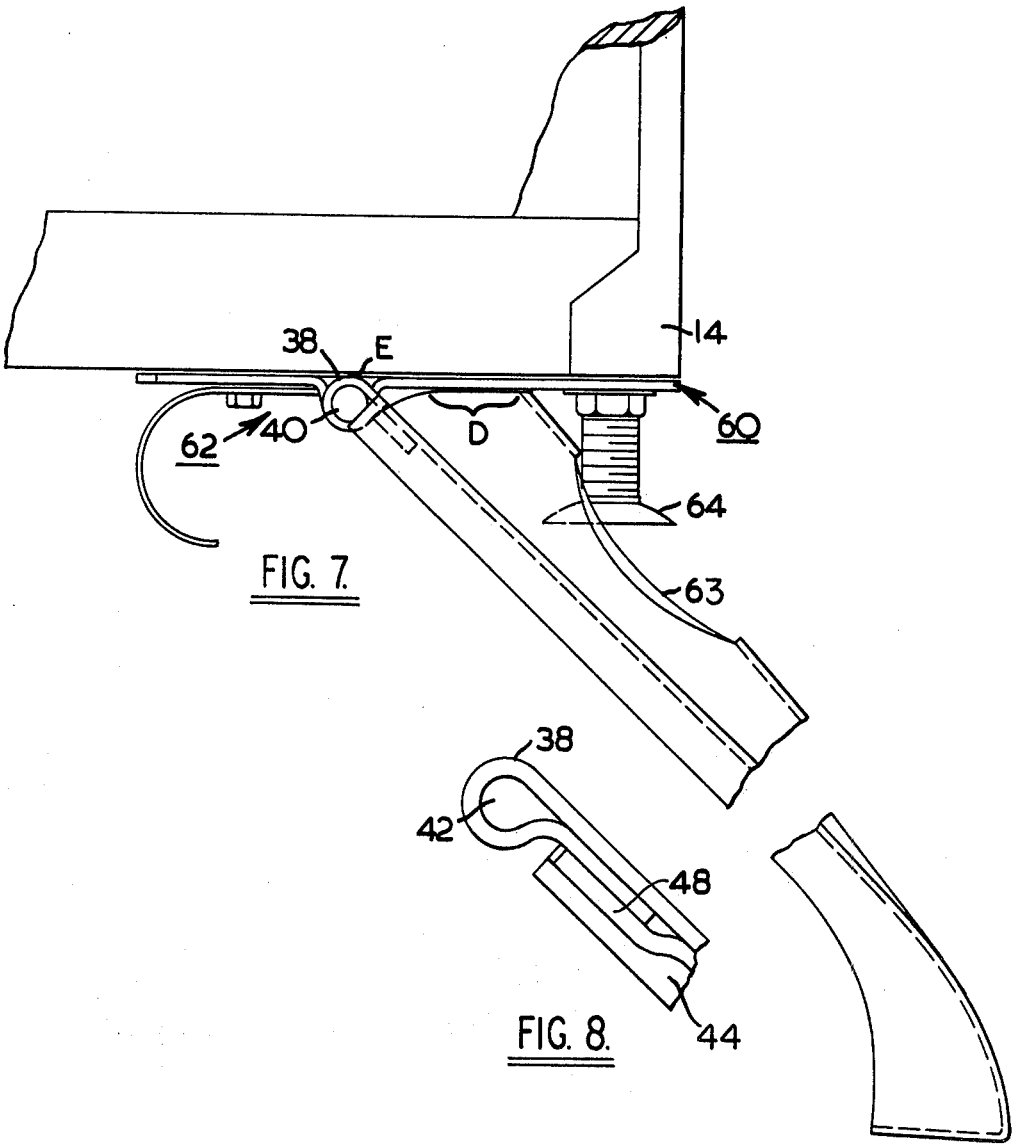
FIG. 7 is a fragmentary side elevation view showing a portion of the base and the leg and hinge plate structure.
FIG. 8 is a side elevation view of the top portion of the leg illustrating the hinge pin receiving means.

With further reference to the leg structure, it will be seen particularly from FIGS. 7 and 11 that the upper edge portion thereof delineated by bracket C in FIG. 11 is so contoured as to define a line of contact which lies in a single plane as illustrated by bracketed portion D shown in FIG. 7. By virtue of this arrangement, thrust forces are generally distributed along such line of contact thus reducing the possibility of buckling of the sheet metal member 32 during use. These thrust forces are transmitted to the hinge plate 60 which will be described herein after.

It should also be noted that the legs 30 are provided with generally elliptically shaped apertures 63 which are located such that when the legs are in their unfolded operative positions, no interference arises between such legs and the downwardly extending floor engaging feet 64 which are connected to hinge plate 60 adjacent the four corners of same. It will of course be appreciated here that when legs 30 are in their inwardly folded positions, the adjustable feet 64 of base member 14 rest directly on the floor.

We will now turn to the hinge plate 60 and the spring clip means 62 associated therewith.

It will be seen from FIG. 9 that the hinge plate 60 is of generally triangular configuration. Hinge plate 60 is provided with numerous projection weld features 65 for resistance welding of the hinge plate to the base to securely attach the hinge plate to the corner of the base 14 in one operation. When attached to the base member 14, the edges 66 and 68 of the base plate are parallel to the associated edges of base 14 with the apex 70 of the hinge plate being disposed at the associated corner of base 14. An extruded and internally threaded bore is provided adjacent apex 70 of the hinge plate into which the stud of the adjustable foot 64 is threaded to enable ready adjustment of such foot.

It will be seen from FIG. 9 that hinge plate 60 is provided with inwardly recessed portions 72 in each of the sides 66 and 68 to receive the aperture defining means 38 of the leg member 30. Inwardly of these recesses, the hinge plate is provided with integrally formed loops 74, which may be provided by a simple metal stamping and forming operation, such loops extending downwardly from the hinge plate 60 in use and defining a channel through which the hinge pin 40 may be passed. It will be seen from FIG. 9 that the aperture defining means 38 of the legs are disposed immediately adjacent to and flank the loops 72 formed in the hinge plate.

It should also be noted here, with reference to FIG. 7 that the aperture defining means 38 of each leg 30 is capable of contacting and transmitting thrust forces directly to the base 14. Thus, under certain conditions encountered in use, the aperture defining means 38 can come into direct contact with the base 14 at point E as shown in FIG. 7. This serves, under certain conditions, to take some of the load off the hinge pin 74.

Figure 10:
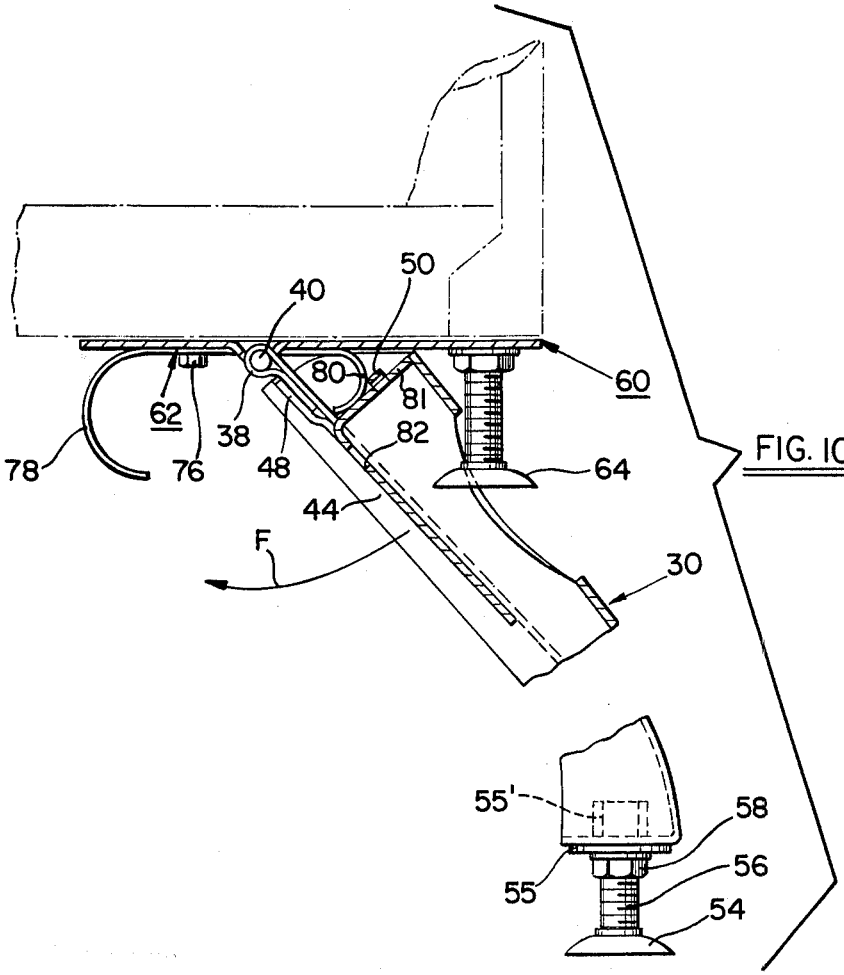
FIG. 10 is a view similar to FIG. 7, but with a portion of the upper end of the leg being cut away to show the manner in which the leg cooperates with the spring clip for retention of the leg in operative and inoperative positions.

We will now turn to the spring clip 62 for resiliently retaining the leg in either the collapsed or the operative position. Reference is had particularly to FIGS. 9 and 10. It will be seen that the spring clip 62 comprises an elongated strip of resilient metal and is secured to the underside of the hinge plate 60 by spaced apart fastener means 76 as illustrated in FIGS. 9 and 10. The opposing ends of the spring clip are provided with smoothly curved end portions 78 and 80 respectively. The curved end portion 80 on one end of spring clip 62 is arranged to come into engagement with and be deflected by the previously mentioned tang 50 which is integrally formed with a perpendicularly extending portion 81 of the above noted reinforcement plate 44 welded to leg 30. Thus, as leg 30 is being moved to the operative position, tang 50 contacts end portion 80 and deflects same slightly thereby allowing tang 50 to move to a position behind a portion of such curved end portion 80 as shown in FIG. 10, whereby leg 30 is the resiliently maintained in the extended operative position. The other curved end 78 on the spring clip 62 is positioned and arranged to enter aperture 52 and to engage and be deflected by edge portion 82 of the aperture 52 in leg reinforcement plate 44. Thus, as leg 30 is swung into the folded inoperative position in the direction of arrow F, edge portion 82 contacts curved end portion 78 and deflects same sufficiently so that edge portion 82 becomes positioned behind a part of the curved end portion 78 whereby to resilienly maintain leg 30 in the folded inoperative position as shown for example in FIGS. 1 and 3.

Figure 6:
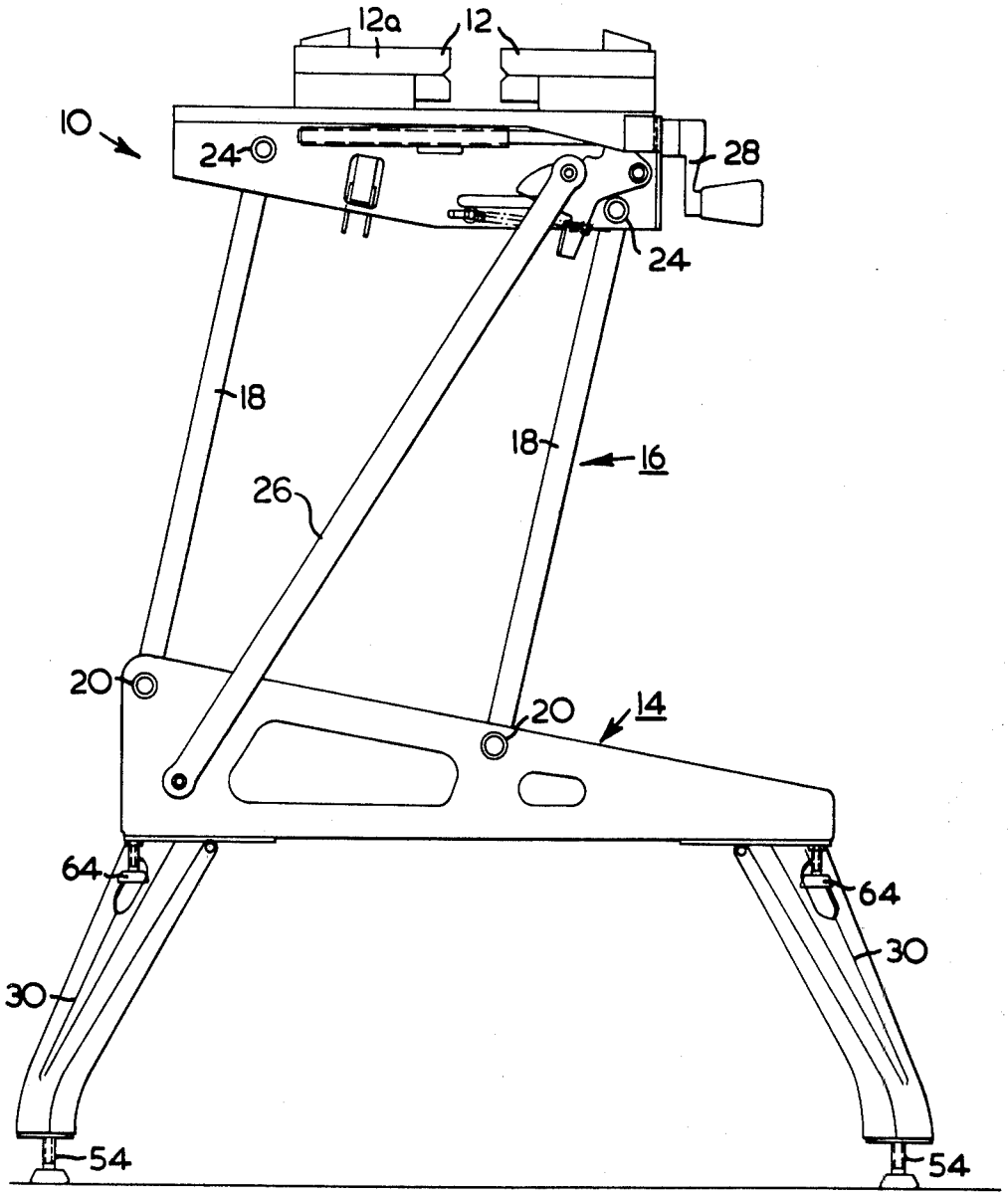

Thus, by virtue of the above described features, the legs 30 are resiliently retained in either their folded inoperative positions a shown in FIGS. 1 and 3 or the unfolded downwardly and outwardly inclined operative positions as shown in FIGS. 2, 5 and 6. In the folded inoperative position of legs 30, the adjustable feet 64 of the base 14 make direct contact with the floor and this, as mentioned previously defines the lower working position of the workbench. With the legs 30 in their unfolded operative positions, the feet 54 of legs 30 contact the floor thus defining the upper working position of the workbench. Furthermore, as mentioned previously, by virtue of the downwardly and outwardly inclined arrangement of leg 30, their respective floor contacting feet contact the floor a substantial distance outwardly beyond the margins of the base 14, as seen in plan, thereby to provide additional stability to the workbench as a whole in the higher working position of same.

It will therefore be seen that the above described embodiment provides an improved foldable leg assembly for use in combination witth dual-height workbenches and like devices, which assembly is simple in construction, requires no foldable braces or stays and which includes an extremely simple bracket or hinge plate structure to connect the legs to the work base bench, the legs being constructed and arranged to provide adequate stability to the workbench in the higher position of same. Those skilled in the art will realize that numerous modifications may be made to the described embodiment within the scope of the invention and accordingly, in determining the scope of the invention, reference is to be had to the appended claims.

We claim:

1. A dual height workbench or the like comprising:

top members defining a working surface; a base defining longitudinal and transverse axes; support structure for supporting said top members above said base; and, a plurality of legs pivotally attached to said base adjacent outer edge portions of same and movable between inwardly folded inoperative positions corresponding to the lower height of the workbench and outwardly and downwardly inclined operative positions relative to said base corresponding to the higher position of the workbench, the pivotal attachment of the respective legs being such that each of said legs is capable of movement in an arc lying in a plane which is at an acute angle relative to the longitudinal and transverse axes of said base, each said leg including at its upper end pivot axis defining means, with a portion of said upper end spaced from said pivot axis defining means being shaped to transmit thrust forces to said base and to limit the degree of outward pivotal motion of said leg thus to define the outwardly and downwardly inclined operative position of each leg, and, said base being provided with a plurality of support feet for contacting a floor surface in the lower position of the workbench, each support foot being located adjacent a respective one of said legs, and each said leg having a recess or opening therein for receiving a portion of the associated support foot therein the operative position of such leg whereby to avoid interference between each leg and the adjacent support foot of the base.

2. A dual elevation workbench or the like comprising:

bench top means for defining a working surface;

a base defining a rectangular outline;

support structure for supporting said bench top means above said base;

a plurality of legs; and, hinge pivot means for pivotally attaching said legs to said base respectively, each of said legs being pivotally attached to said base so as to be pivotally movable between respective inwardly folded inoperative positions corresponding to the lower elevation of the workbench and respective outwardly and downwardly inclined operative positions relative to said base corresponding to the higher elevation of the workbench, said legs being pivotally attached to said base by said respective hinge means so as to cause said legs in said operative positions to extend outwardly in respective directions defined substantially by the diagonals of said rectangular outline and away from said rectangular base in splayed fashion to locations on the floor outside of and beyond a plan projection of said bench top means and said base on the floor whereby the workbench will remain in static equilibrium irrespective of where a load is applied to said working surface and said base.

3. A workbench according to claim 2 wherein said hinge pivot means of each leg includes aperture defining means formed on said leg for receiving a pivot oriented to provide said movement of the leg.

4. A workbench according to claim 3 wherein each said hinge pivot means includes a hinge plate secured to said base, said hinge plate comprising a plate having loops formed therein receiving the pivot pin, said loops disposed immediately adjacent said aperture defining means.

5. A workbench according to claim 3 wherein each said leg includes a one-piece elongated sheet metal piece having a longitudinally extending crimp therein such that, as seen in cross-section, edge portions of such leg are offset from inwardly disposed portions of the leg sufficiently to assist in providing the required degree of leg strength.

6. A workbench according to claim 5 wherein said portion of said upper end of said leg is shaped such that it defines a line of contact lying in a single plane whereby said thrust forces are distributed along said line.

7. A workbench according to claim 4 wherein each said leg includes a one-piece elongated sheet metal piece having a longitudinally extending crimp therein such that, as seen in cross-section, edge portions of such leg are offset from inwardly disposed portions of the leg sufficiently to assist in providing the required degree of leg strength.

8. A workbench according to claim 7 wherein said portion of said upper end of said leg is shaped such that it defines a line of contact lying in a single plane whereby said thrust forces are distributed along said line.

9. The workbench according to claim 7 wherein the aperture defining means of each said leg is capable of contacting and transmitting thrust forces to said base.

10. The workbench according to claim 2 wherein said base is of generally rectangular configuration with said leg members each being connected thereto adjacent a respective one of the four corners of the base.

11. The workbench according to claim 2 including means for resiliently holding each said leg in the folded inoperative position and the outwardly disposed operative position.

12. The workbench according to claim 2 wherein said base is provided with a plurality of support feet for contacting a floor surface in the lower elevation of the workbench, each support foot being located at a respective corner of the base adjacent a respective oneof said legs, each of the legs being provided with a respective floor contacting means with said legs being shaped such that when the legs are in their operative positions their floor contacting means are disposed a substantial distance outwardly beyond the margins of the base, as seen in plan, to provide added stability to the workbench in the higher elevation of the latter.

13. The workbench according to claim 2 wherein said support structure for supporting said bench top means above said base has pivot means associated therewith to permit the workbench to be collapsed and the top members brought into juxtaposition with the base for ease of transport and storage of the workbench.

14. The dual elevation workbench of claim 2 each of said legs being an elongated sheet metal member.

15. A dual elevation workbench or the like comprising:

bench top means for defining a working surface;

a base;

support structure for supporting said bench top means above said base;

a plurality of legs, each of said legs being formed to define a one-piece, triangular-like structure having a three-sided triangular-like upper end and tapered toward an apex defining the foot of the leg; and, a plurality of hinge pivot means for pivotally attaching said legs respectively to said base at one of the sides of said three-sided, triangular-like upper end so as to be pivotally movable between respective inwardly folded inoperative positions corresponding to the lower elevation of the workbench and respective outwardly and downwardly inclined operative positions relative to said base corresponding to the higher elevation of the workbench whereat the other two sides of said three-sided triangular-like upper end of each of said legs coact with said base to define said operative position so as to place the corresponding foot on the floor a sufficient distance away from said rectangular base and said bench top means so that the workbench will remain in static equilibrium irrespective of where a load is applied to the workbench.

16. The dual elevation workbench of claim 5 each of said legs being an elongated sheet metal member.

17. A dual elevation workbench or the like comprising:

bench top means for defining a working surface;

a base;

support structure for supporting said bench top means above said base;

a plurality of legs; and, hinge pivot means corresponding to respective ones of said legs for pivotally attaching said legs to said base adjacent outer edge portions so as to be pivotally movable between respective inwardly folded inoperative positions corresponding to the lower elevation of the workbench and respective outwardly and downwardly inclined operative positions corresponding to the higher elevation of the workbench, the pivotal attachment of the respective legs being such that in said operative positions said legs extend outwardly away from said base in splayed fashion to locations on the floor outside of and beyond a plan projection of said bench top means on the floor, each of said legs having structure means engaging said base outboard of said corresponding hinge pivot means for coacting with said hinge pivot means to transmit thrust forces developed by loads applied to said working surface from said base to said floor locations whereby the workbench will remain in static equilibrium irrespective of where a load is applied to said working surface.

18. The dual elevation workbench of claim 17, each of said legs being an elongated sheet metal member.

19. A dual elevation workbench or the like comprising:

bench top member for defining a working surface;

a base defining a rectangular outline;

support structure for supporting said bench top means above said base;

a plurality of legs, each of said legs being formed to define a three-dimensional triangular-like structure having a three-sided triangular-like upper end and tapered toward an apex defining the foot end of the leg; and, a plurality of hinge pivot means for pivotally attaching said legs respective to said base such that said legs are movably outwardly away from said base in respective directions defined substantially by the diagonals of said rectangular outline;

each of said legs being pivotally attached to said base by a corresponding one of said hinge pivot means at one of the sides of said three-sided triangular-like upper end so as to be pivotally movable between an inwardly folded inoperative position corresponding to the lower elevation of the workbench and an outwardly and downwardly splayed inclined operative position relative to said base corresponding to the higher elevation of the workbench whereat the other two sides of said three-sided triangular-like upper end of said leg contact said base outboard of said hinge pivot means to define said operative position and to coact with said hinge pivot means to transmit thrust forces developed by loads applied to said working surface from said base to locations on the floor outside of and beyond a plan projection of said bench top means on the floor whereby the workbench will remain in static equilibrium irrespective of where a load is applied to said working surface.

20. The dual elevation workbench of claim 19, each of said legs being an elongated sheet metal member.

* * * * *